US005521329A

United States Patent [19]

Yamauchi et al.

[11] Patent Number: 5,521,329

[45] Date of Patent: May 28, 1996

[54] MUSICAL TONE SYNTHESIZING APPARATUS INCLUDING LOOP GAIN CONTROL

[75] Inventors: Akira Yamauchi; Masashi Hirano, both of Hamamatsu, Japan

[73] Assignee: Yamaha Corporation, Japan

[21] Appl. No.: 184,699

[22] Filed: Jan. 21, 1994

[30] Foreign Application Priority Data

Jan. 26, 1993 [JP] Japan ..... 5-011134

[51] Int. Cl.[6] ..... G10H 1/12

[52] U.S. Cl. ..... 84/661; 84/DIG. 9; 84/DIG. 10

[58] Field of Search ..... 84/622–5, 661, 84/699, 700, 736, DIG. 9, DIG. 10

[56] References Cited

U.S. PATENT DOCUMENTS

| | | | |
|---|---|---|---|
| Re. 31,004 | 8/1982 | Niimi . | |
| 4,655,115 | 4/1987 | Nishimoto | 84/DIG. 10 |
| 5,252,776 | 10/1993 | Mutoh | 84/661 X |
| 5,382,751 | 1/1995 | Kitayama et al. | 84/661 |

FOREIGN PATENT DOCUMENTS 3-163597 7/1991 Japan .

*Primary Examiner*—Stanley J. Witkowski
*Attorney, Agent, or Firm*—Graham & James

[57] ABSTRACT

A musical tone synthesizing apparatus provides a closed loop containing an adder, a delay circuit, a filter and a gain control portion. The delay circuit has a delay time which is set responsive to a tone pitch of a musical tone to be produced. An excitation signal is produced in response to the musical tone to be produced and is introduced into the closed loop through the adder, so that the excitation signal circulates through the closed loop. The gain control portion is provided to control a loop gain of the closed loop on the basis of a preset parameter and another parameter which is controlled responsive to a tone color of the musical tone to be produced. The signal circulating through the closed loop is picked up as a musical tone signal representing the musical tone to be produced. By controlling the loop gain of the closed loop, an attenuation characteristic of the musical tone signal is controlled. Hence, it is possible to freely control a sounding time of a decay sound such as a guitar sound.

13 Claims, 5 Drawing Sheets

MUSICAL TONE SYNTHESIZING APPARATUS INCLUDING LOOP GAIN CONTROL

BACKGROUND OF THE INVENTION

1. Field of the Invention

The present invention relates to a musical tone synthesizing apparatus which is capable of synthesizing sounds of non-electronic musical instruments by using a closed-loop circuit.

2. Prior Art

The musical tone synthesizing apparatuses, which are conventionally known and are disclosed by U.S. Pat. No. Re. 31,004 and Japanese Patent Laid-Open Publication No. 3-163597, are designed to synthesize the sounds of the non-electronic musical instruments by simulating their tone-generation mechanisms. Among them, the musical tone synthesizing apparatus which is designed to simulate sounds of stringed instruments utilizes a closed-loop circuit containing a filter and a delay circuit. Herein, the filter (e.g., low-pass filter) is provided to simulate a reverberation loss of the string, while the delay circuit is provided to simulate a propagation delay which is occurred when vibrating the string. Now, an excitation signal corresponding to an impulse or the like is introduced into the closed-loop circuit in response to the vibration applied to the string; and then, the excitation signal circulates through the closed-loop circuit. In this case, the excitation signal circulates through the closed-loop circuit once in a duration corresponding to a vibration period of the string. While circulating through the closed-loop circuit, a frequency band of the excitation signal is limited by the low-pass filter. Thereafter, the signal circulating through the closed-loop circuit is picked up as a musical tone signal which simulates the sound of the stringed instrument.

In the above-mentioned musical tone synthesizing apparatus which simulates the tone-generation mechanism of the stringed instrument, a delay time of the delay circuit and characteristics of the low-pass filter are respectively adjusted so as to synthesize the sounds of the non-electronic stringed instruments. The non-electronic stringed instrument represents a string-plucking-type instrument such as a guitar, a string-striking-type instrument such as a piano and the like.

Meanwhile, the guitar produces a decay sound which is naturally attenuated in a lapse of time. When simulating the decay sound by the aforementioned musical tone synthesizing apparatus, a loop gain of the closed-loop circuit is set at a specific value such as "0.9995", for example. This value enables the musical tone synthesizing apparatus to produce a natural decay sound whose sounding time is approximately ranged from three seconds to ten seconds. Actually, however, such sounding time may be varied by a tone pitch (i.e., delay time) or some parameters of the low-pass filter which are set due to the reverberation loss to be occurred.

When reducing the above-mentioned value to "0.95", the sounding time of the musical tone (i.e., decay sound) to be produced is extremely reduced to 0.1 second, for example. Such extreme reduction of the sounding time is occurred based on the fact in which when a frequency of the musical tone is set at 1 KHz, the musical tone is subjected to gain adjustment using the loop gain of 0.95 by one-thousand times in one second. This fact proves that a numeric value of the loop gain greatly affects the sounding time of the musical tone to be produced. In order to achieve a fine adjustment in an attenuation time (corresponding to the sounding time of the decay sound), it is necessary to provide a specific resolution by which four to six digits below the decimal point in the decimal notation can be clearly set. When realizing the musical tone synthesizing apparatus having the above-mentioned resolution by the digital system, 16-bit data processing system should be required, because the 16-bit data can achieve a large resolution which represents 65536 stages.

In the meantime, when the loop gain ranges from "0" to "0.9", the musical tone to be produced cannot be sustained even for a very short period of time. Hence, those values ranging from "0" to "0.9" are hardly used for the loop gain which is a fundamental parameter for the musical tone synthesis. In short, the aforementioned high resolution is not required for the loop-gain parameter whose value is set in a range of those values. Further, it requires much working time to adjust the attenuation of the musical tone by use of the loop-gain parameter having a high resolution which is set by a five-digit number such as "65536". For this reason, it is demanded to realize the above-mentioned loop-gain parameter by use of 7-bit data having a resolution of "128" stages, because popular synthesizer systems are configured to use the 7-bit data. In order to do so, a conversion table is provided especially for the loop-gain parameter, which is different from the other parameters. According to the function of the conversion table, the resolution can be raised as long as the loop-gain parameter is set in a specific value range, whereas the resolution is reduced when the loop-gain parameter is in a range of the values which are not substantially used for the musical tone synthesis. Therefore, most of the "128" stages represented by the 7-bit data are used for the loop-gain parameter which is in a range between "0.99" and "1", while the remaining stages are used for the loop-gain parameter which is in a range between "0.99" and "0". For example, "100" stages are used for the former loop-gain parameter, while tens of the stages are used for the latter loop-gain parameter.

By the way, an actual variation manner of the loop-gain which is used when actually playing the electronic musical instrument is very complicated. In the case of the so-called feedback performance of the electric guitar, the loop gain is normally set at or set above "1". In order to synthesize such electric-guitar sounds, the loop-gain parameter is set above "1" (e.g., "1.2"). In such case, an oscillation of the closed-loop circuit may be grown so that the tone volume becomes larger and larger. However, due to the effects of the non-linear characteristics of the electronic musical instrument and distortion circuits, the waveforms are deformed (or clipped), so that the tone volume is eventually converged upon an appropriate level.

As described heretofore, the actual electronic musical instruments use several kinds of values as the loop-gain parameter. In some cases, the loop-gain parameter is set around "1", or the loop-gain parameter is varied in a complicated manner. In the conventional apparatus, the loop gain is controlled by use of a single parameter. In such case, however, a complicated setting operation should be required for the loop gain.

SUMMARY OF THE INVENTION

It is an object of the present invention to provide a musical tone synthesizing apparatus which can achieve a complicated gain control for the musical tones to be produced by a simple configuration.

According to a fundamental configuration of the present invention, a musical tone synthesizing apparatus is configured by an excitation portion, a loop circuit, first and second parameter setting portions. Herein, the first parameter setting portion sets a first gain parameter in response to a tone color of a musical tone to be produced, while the second parameter setting portion sets a second gain parameter in response to a music-performing operation such as a key-depressing operation made by a performer. The loop circuit has a loop gain which is controlled on the basis of the first and second gain parameters. The loop circuit at least provides a delay circuit whose delay time is set responsive to a tone pitch of the musical tone to be produced. The excitation portion produces an excitation signal which is introduced into the loop circuit so that an oscillation is excited in the loop circuit.

By use of the first and second gain parameters, it is possible to easily perform a complicated gain control on the loop gain of the loop circuit.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENT

Figure 1:
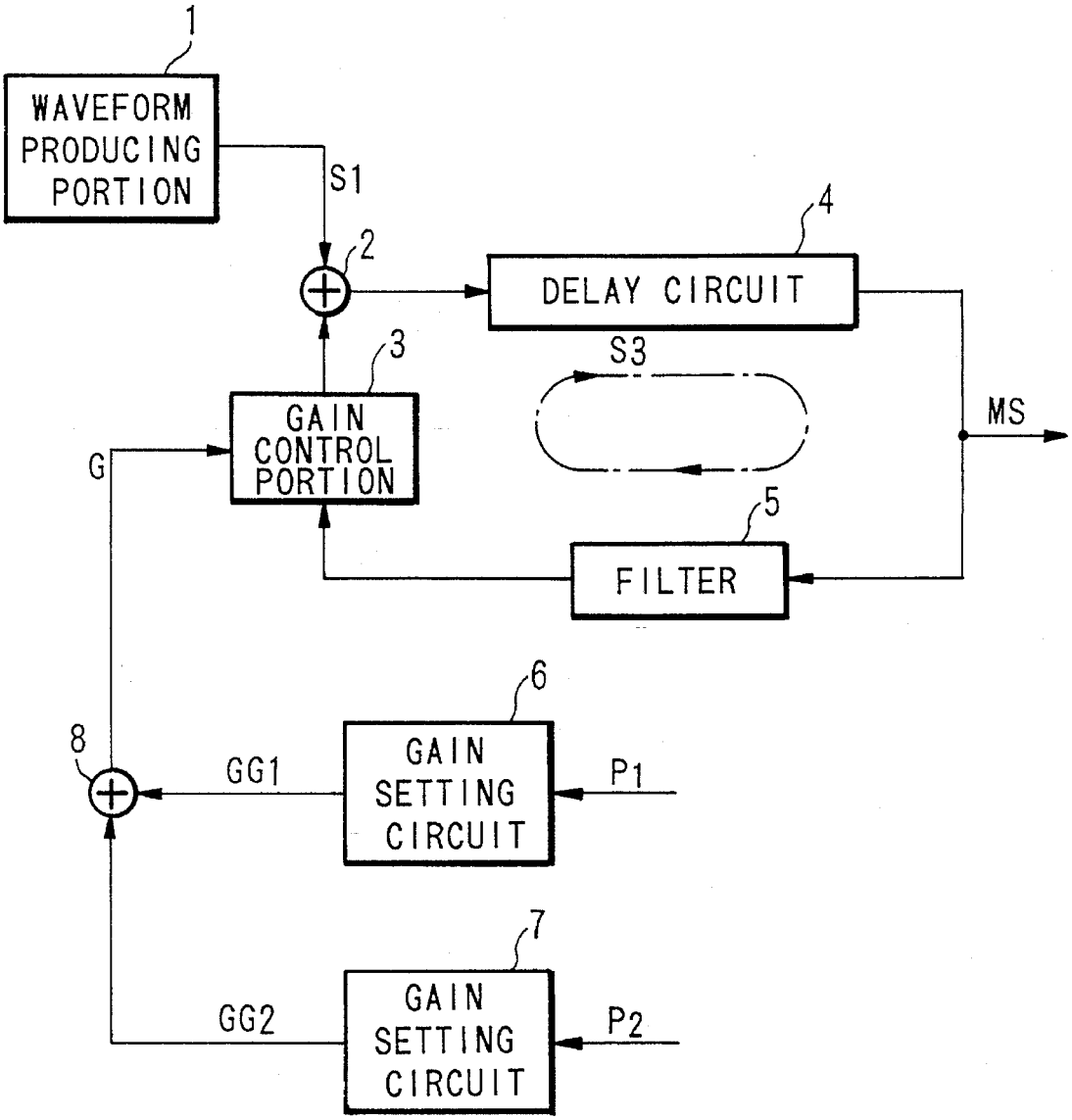
FIG. 1 is a block diagram showing a fundamental configuration of a musical tone synthesizing apparatus according to an embodiment of the present invention.

Now, a preferred embodiment of the present invention will be described by referring to the drawings wherein parts identical to those shown in several drawings are designated by the same numerals.

FIG. 1 is a block diagram showing a fundamental configuration of the musical tone synthesizing apparatus according to an embodiment of the present invention. In FIG. 1, a numeral 1 denotes a waveform producing portion which produces a fundamental waveform signal S1 in response to an operation applied to a predetermined manual-operable member (not shown). This fundamental waveform signal S1 is supplied to an adder 2. The adder 2 adds the fundamental waveform signal S1 to an output of a gain control portion 3 so as to output a result of the addition thereof to a delay circuit 4. For convenience' sake, a signal circulating through a closed loop is called a circulating signal S3. The circulating signal S3 is delayed by a predetermined delay time in the delay circuit 4; and then, the circulating signal S3 delayed by the predetermined delay time is supplied to a filter 5. That circulating signal S3 is subjected to filtering operation by the filter 5; and then, an output of the filter 5 is delivered to the gain control portion 3.

The gain control portion 3 is configured by a multiplier, in which the circulating signal is multiplied by a coefficient corresponding to a gain G. The gain G is obtained from an adder 8 which adds outputs of gain setting circuits 6 and 7 together. The gain setting circuit 6 receives a parameter P1 which is supplied thereto from a control portion. Incidentally, details of the control portion will be described later. The parameter P1 is produced responsive to a musical tone to be produced. In response to the parameter P1, the gain setting circuit 6 produces a gain GG1, which is supplied to a first input of the adder 8. Similarly, the gain setting circuit 7 receives a parameter P2 which is supplied thereto from the control portion. The parameter P2 is produced responsive to a state of a manual-operable member (not shown) operated by a performer. In response to the parameter P2, the gain setting circuit 7 produces a gain GG2, which is supplied to a second input of the adder 8. The adder 8 adds those gains GG1 and GG2 together so as to produce the aforementioned gain G. As described before, the circulating signal S3 circulates through the closed loop consisting of the adder 2, the delay circuit 4, the filter 5 and the gain control portion 3. At a specific point of the closed loop (i.e., at a certain point on the line between the delay circuit 4 and the filter 5), the circulating signal S3 is picked up as a musical tone signal MS. This musical tone signal MS is supplied to another circuit portion. (not shown) by which the musical tone is correspondingly produced.

Figure 2:
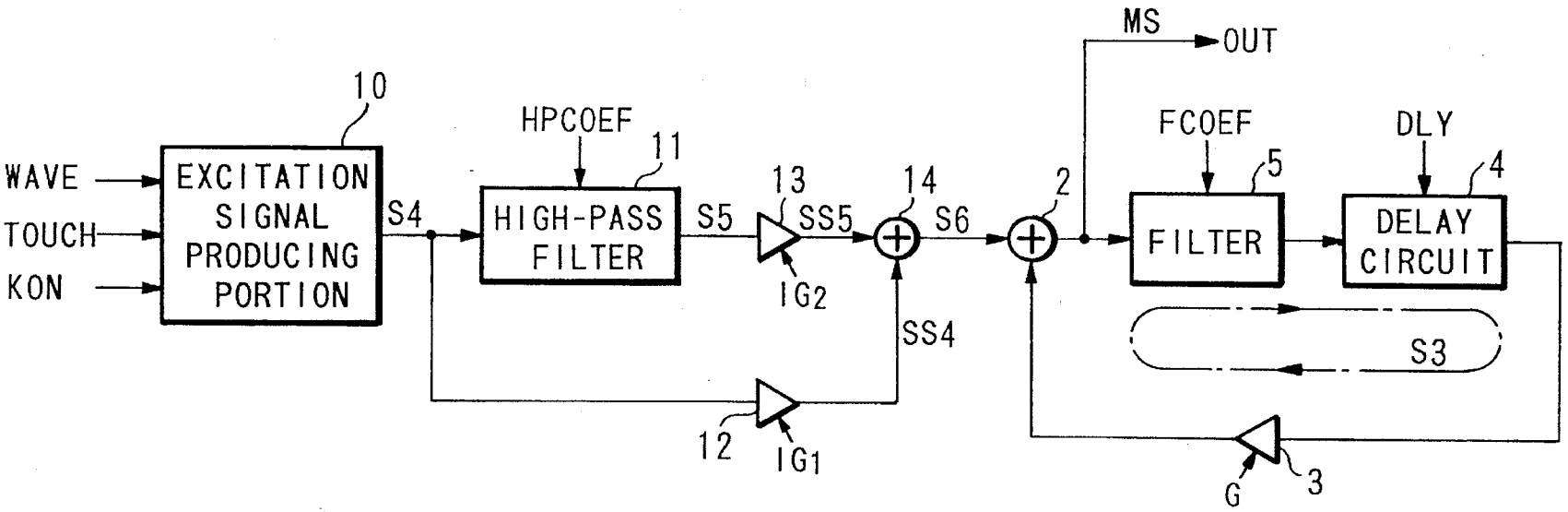
FIG. 2 is a block diagram showing an actual circuit configuration of the musical tone synthesizing apparatus.

FIG. 2 shows a certain part of the circuitry corresponding to the musical tone synthesizing apparatus; and this part is different from another part of the circuitry (see FIG. 1) which relates to a gain-adjustment function. Hereinafter, that part will be described in detail by referring to FIG. 2, in which parts identical to those shown in FIG. 1 are designated by the same numerals; hence, the description thereof will be omitted. In FIG. 2, a numeral 10 denotes an excitation signal producing portion which produces an excitation signal S4 in response to a key-on signal KON, a waveform selecting signal WAVE and a touch signal TOUCH. Those signals are given from the control portion in response to a music-performing operation made by the performer. Herein, the key-on signal KON represents a key-depression event, while the waveform selecting signal WAVE selectively indicates a musical tone waveform corresponding to the key-depression event, and the touch signal TOUCH represents a key-depression intensity. Then, the excitation signal producing portion 10 outputs the excitation signals S4 corresponding to a predetermined number of periods. Those excitation signals S4 are sequentially delivered to both of a high-pass filter 11 and a multiplier 12. The high-pass filter 11 is provided to remove dc components from the excitation signal S4. Because, such dc components may be incorporated in the excitation signal S4 when a continuous-wave signal (such as a white-noise signal) having a relatively long time length is used as the fundamental waveform signal. The high-pass filter 11 also receives a coefficient HPCOEF given from the control portion. This coefficient HPCOEF is used to set a cut-off frequency of the high-pass filter 11. The excitation signal S4 is subjected to high-pass filtering operation in the high-pass filter 11, from which a filtered signal is outputted as an excitation signal S5. This excitation signal S5 is supplied to a multiplier 13.

The multipliers 12 and 13 receive multiplication coefficients IG1 and IG2 respectively. Thus, the multiplier 12 multiplies the excitation signal S4 by the multiplication coefficient IG1 so as to produce a signal SS4. Similarly, the multiplier 13 multiplies the excitation signal S5 by the multiplication coefficient IG2 so as to produce a signal SS5.

Those signals SS4 and SS5 are added together by an adder 14. An output of the adder 14 is supplied to the adder 2, provided in the closed loop, as an excitation signal S6. In short, the multipliers 12, 13 and the adder 14 are provided to set a certain balance between two components (i.e., signals S4 and S5) in the excitation signal S6 which is introduced into the closed loop. By adjusting the multiplication coefficients IG1 and IG2, a high-pass filtering characteristic applied to the excitation signal S4 can be altered. In the closed loop shown in FIG. 2, a multiplier is employed as the gain control portion 3, while a delay amount DLY given from the control portion is supplied to the delay circuit 4 so as to set its delay time. Further, the filter 5 receives a coefficient FCOEF which is used to set the cut-off frequency thereof. As a typical example, each filter is designed to have a certain gain which is set at "1".

Figure 3:
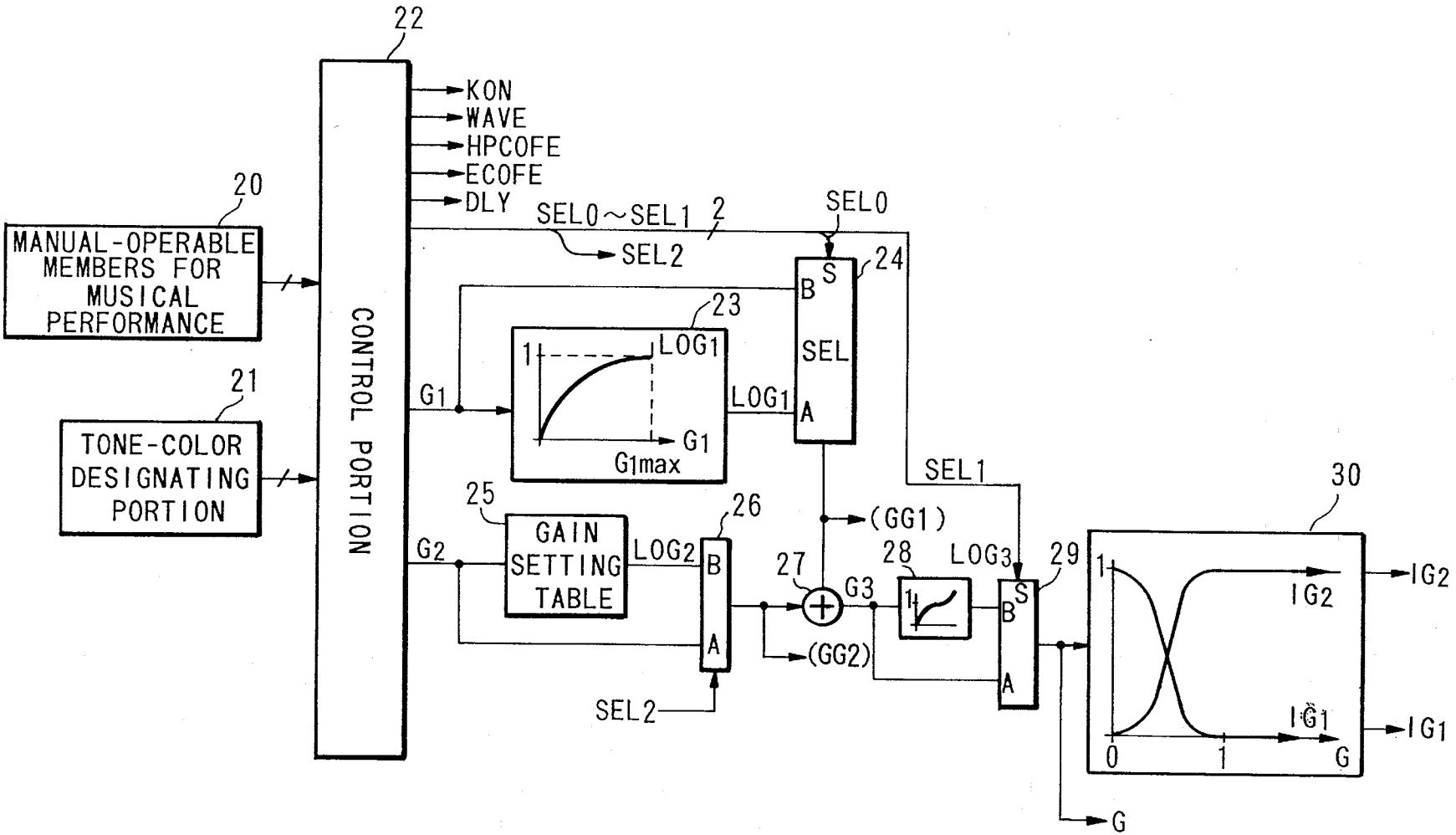
FIG. 3 is a block diagram showing a control portion and its peripheral circuits which are provided to produce several kinds of parameters.

Next, FIG. 3 shows a circuitry which contains the aforementioned gain setting circuits 6, 7 and the aforementioned control portion producing several kinds of parameters and coefficients as described before. Hereinafter, a detailed configuration and operations of that circuitry will be described by referring to FIG. 3. In FIG. 3, a numeral 20 denotes manual-operable members for the musical performance. Actually, the numeral 20 denotes a keyboard consisting of black keys and white keys. An operating state of each key in the keyboard is reported to a control portion 22. A numeral 21 denotes a tone-color designating portion which is used to designate a desired tone color. For example, the tone-color designating portion 21 contains a plurality of tone-color selecting switches. An operating state of each switch is reported to the control portion 22. The tone-color designating portion 21 further provides a control member by which the gain G to be supplied to the aforementioned gain control portion 3 is adjusted. On the basis of the operating states of the manual-operable member 20 and the tone-color designating portion 21, the control portion 22 produces selecting signals SEL0, SEL1, SEL2 and gain setting signals G1, G2 as well as the aforementioned key-on signal KON, the waveform selecting signal WAVE, the coefficient HPCOEF for the high-pass filter 11, the coefficient FCOEF for the filter 5 and the delay amount DLY. Incidentally, the gain setting signal G1 has a preset value which is set in advance in response to the tone color of the musical tone to be produced. In contrast, the gain setting signal G2 has a variable value which can be varied responsive to a manual operation applied to the control member provided in the tone-color designating portion 21.

The gain setting signal G1 is delivered to a gain setting table 23 and an input B of a selector 24. In response to the gain setting signal G1, a non-linear gain LOG1 is correspondingly read from the gain setting table 23. Herein, the non-linear gain LOG1 has a value which is varied between "0" and "1". That nonlinear gain LOG1 is supplied to an input A of the selector 24. The value of the non-linear gain LOG1 is gradually increased as the gain G1 becomes close to the maximum value (i.e., "G1max" in the gain setting table 23). When the gain G1 becomes equal to the maximum value, the value of the non-linear gain LOG1 becomes equal to "1". The non-linear conversion of the gain setting table 23 is determined such that the resolution thereof is raised when the gain G1 is set in proximity to "1". The selector 24 receives the aforementioned selecting signal SEL0 at a select terminal thereof. In response to the selecting signal SEL0, one of the signals supplied to the inputs A and B of the selector 24 is selected. In other words, one of the gain setting signal G1 and the non-linear gain LOG1 is selectively outputted to a first input of an adder 27 as the foregoing gain GG1.

On the other hand, the gain setting signal G2 is delivered to a gain setting table 25 and an input A of a selector 26. The gain setting table 25 is configured as similar to the aforementioned gain setting table 23. In response to the gain setting signal G2, the gain setting table 25 outputs a non-linear gain LOG2 whose value is varied between "0" and "1". Herein, the resolution of the non-linear table 25 is adjusted as described before. The non-linear gain LOG2 is supplied to an input B of the selector 26. The selector 26 receives the aforementioned selecting signal SEL2 at a select terminal thereof. In response to the selecting signal SEL2, one of the signals supplied to the inputs A and B of the selector 26 is selected. In other words, one of the gain setting signal G2 and the non-linear gain LOG2 is selectively outputted to a second input of the adder 27 as the foregoing gain GG2.

The adder 27 adds the gains GG1 and GG2 together so as to produce a gain G3. The gain G3 is delivered to a gain setting table 28 and an input A of a selector 29. In response to the gain G3, the gain setting table 28 outputs a non-linear gain LOG3 whose value is gradually changed when the gain G3 is set in proximity to "1". The non-linear gain LOG3 is supplied to an input B of the selector 29. The selector 29 receives the aforementioned selecting signal SEL1 at a select terminal thereof. In response to the selecting signal SEL1, one of the signals supplied to the inputs A and B of the selector 29 is selected. In other words, one of the gain G3 and the non-linear gain LOG3 is selectively outputted from the selector 29 as the foregoing gain G. This gain G is delivered to a multiplication coefficient table 30 as well as the aforementioned gain control portion 3 shown in FIG. 2.

Incidentally, the selecting signals SEL0, SEL1 and SEL2 are respectively controlled by the manual operation applied to the tone-color designating portion 21 such that a combination of the gains can be freely changed.

Based on the gain G, the multiplication coefficient table 30 creates the aforementioned multiplication coefficients IG1 and IG2. Herein, the multiplication coefficient IG1 is reduced from "1" to "0" along a first non-linear curve as the gain G is increased, whereas the multiplication coefficient IG2 is raised from "0" to "1" along a second non-linear curve as the gain G is increased. Those multiplication coefficients IG1 and G2 are respectively supplied to the aforementioned multipliers 12 and 13 shown in FIG. 2. Since the multiplication coefficient G2 is raised up as the gain G is increased, a filtering effect which is obtained by the high-pass filter 11 (see FIG. 2) and is imparted to the excitation signal can be enlarged by increasing the gain G. Incidentally, the first and second non-linear curves set in the multiplication coefficient table 30 are determined such that a sum of the multiplication coefficients IG1 and IG2 is always equal to "1".

Figure 4:
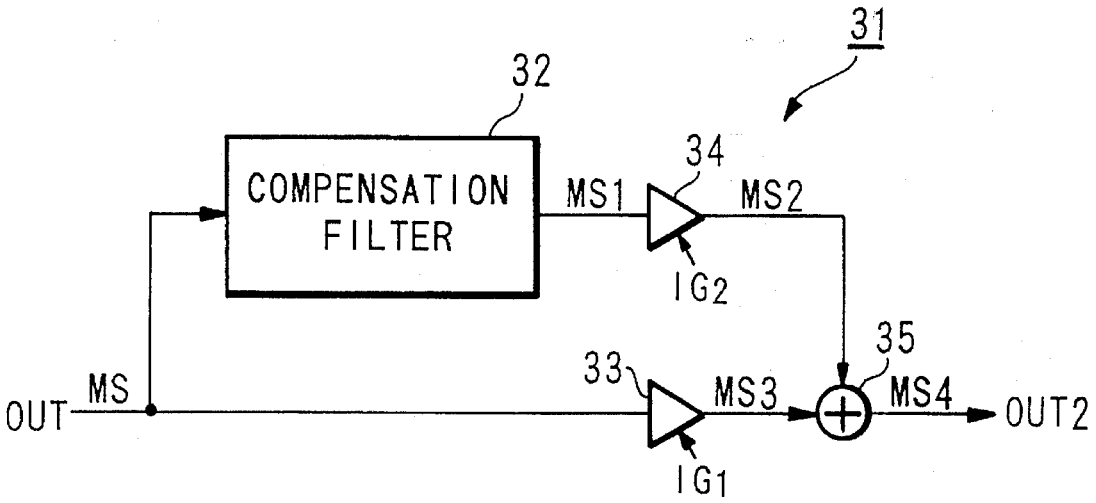
FIG. 4 is a block diagram showing a detailed configuration of a compensation circuit.
Figure 5:
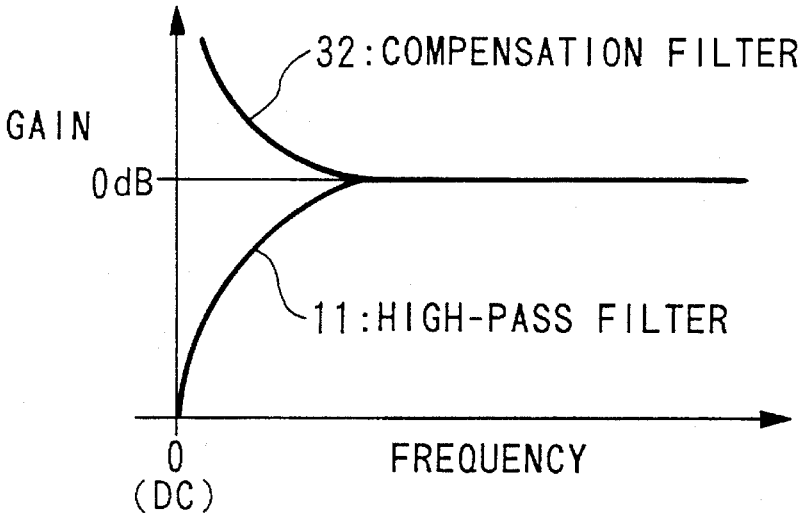
FIG. 5 is a graph showing frequency characteristics of a compensation filter and a high-pass filter.

In FIG. 2, the circulating signal S3 which circulates through the closed loop is picked up as the musical tone signal MS, which is then supplied to a compensation circuit 31 shown in FIG. 4. The compensation circuit 31 is provided to compensate for a loss of the musical tone signal which is occurred by eliminating the dc components from the excitation signal S4 by the aforementioned high-pass filter 11. This compensation circuit 31 contains a compensation filter 32, multipliers 33, 34 and an adder 35. Ideally, the high-pass filter 11 should remove the dc components only from the excitation signal. Actually, however, the high-pass filter 11 would attenuate low-frequency components of the musical tone signals. For this reason, the compensation circuit 31 is provided to compensate for the loss of those low-frequency components. In order to do so, a filtering characteristic of the compensation filter 32 is set reverse to that of the high-pass filter 11 as shown in FIG. 5. Hence, the compensation filter 32 functions to raise up signal levels of the low-frequency components of the musical tone signals. Incidentally, FIG. 5 shows gain characteristics of the high-pass filter 11 and the compensation filter 32, wherein a horizontal axis represents frequency, while a vertical axis represents gain.

In FIG. 4, the aforementioned musical tone signal MS is delivered to the compensation filter 32 and the multiplier 33. The compensation filter 32 effects a filtering operation using the filtering characteristic as shown in FIG. 5 on the musical tone signal MS, so that a filtered musical tone signal MS1 is obtained. This musical tone signal MS1 is supplied to the multiplier 34. The multipliers 33 and 34 respectively receive the foregoing multiplication coefficients IG1 and IG2. Thus, the multiplier 33 multiplies the musical tone signal MS by the multiplication coefficient IG1 so as to produce a signal MS3. Similarly, the multiplier 34 multiplies another musical tone signal MS1 by another multiplication coefficient IG2 so as to produce a signal MS2. Those signals MS2 and MS3 are supplied to the adder 35. The present embodiment is configured such that the outputs of the high-pass filter 11 and compensation filter 32 are mutually related with each other. In short, as an effect of the high-pass filter 11 becomes larger, an effect of the compensation filter 32 correspondingly becomes larger. The adder 35 adds the signals MS2 and MS3 together so as to produce a musical tone signal MS4, which is outputted toward other circuitry (not shown).

According to the present embodiment as described heretofore, a desired gain-conversion route (i.e., a gain-signal-transmission route in the circuitry shown in FIG. 3) is selectively set by manually operating the switches and the like provided in the tone-color designating portion 21. In other words, a desired combination of the gain setting tables is selectively set. Incidentally, it is possible to modify the present embodiment such that the gain 62 can be controlled by operating a predetermined member such as a foot pedal, for example. When the performer operates the manual-operable member 20 so as to designate a start timing for the production of the musical tones, the control portion 22 produces and outputs several kinds of parameters which are used for producing the musical tones. In accordance with the gain-conversion route selected by the performer, the selector 24 selects one of the gain G1 or the non-linear gain LOG1 as the gain GG1 to be supplied to the adder 27. Herein, the gain G1 is produced responsive to the musical tone designated by operating the manual-operable member (e.g., the key of the keyboard), while the non-linear gain LOG1 is outputted from the gain setting table 23 on the basis of the gain G1. On the other hand, the selector 26 selectively outputs one of the gain G2 and the non-linear gain LOG2 as the gain GG2 to be supplied to the adder 27 in accordance with the gain-conversion route selected by the performer. Herein, the gain G2 is produced responsive to the manual operation applied to the manual-operable member by the performer, while the non-linear gain LOG2 is outputted from the gain setting table 25 on the basis of the gain G2. The adder 27 adds those gains GG1 and GG2 together so as to produce the gain G3. Thus, in accordance with the gain-conversion route selected by the performer, the gain G3 is set equal to one of (Gi+G2), (Gi+LOG2), (LOG1+G2) and (LOG1+LOG2).

Further, in accordance with the gain-conversion route selected by the performer, the selector 29 selects one of the gain G3 and the non-linear gain LOG3 as the gain G to be outputted to the aforementioned gain control portion 3 (i.e., multiplier) shown in FIG. 2. Herein, the non-linear gain LOG3 is outputted from the gain setting table 28 on the basis of the gain G3. In response to the gain G, the multiplication coefficient table 30 produces the multiplication coefficients IG1 and IG2, which are respectively supplied to the multipliers 12 and 13 shown in FIG. 2.

In the excitation signal producing portion shown in FIG. 2, the excitation signal S4 of one period is selected in response to the waveform selecting signal WAVE and the touch signal TOUCH; and then, that excitation signal S4 is outputted responsive to the key-on signal KON. The excitation signal S4 is delivered to the high-pass filter 11 and the multiplier 12. The high-pass filter 11 performs the high-pass filtering operation on the excitation signal S4 on the basis of the cut-off frequency which is set responsive to the coefficient HPCO EF; and then, the filtered signal S5 is supplied to the multiplier 13. A mixing ratio between the signals SS4 and SS5 to be mixed together by the adder 14 depends upon the multiplication coefficients IG1 and IG2 which are respectively supplied to the multipliers 12 and 13. Then, a sum of those signals SS4 and SS5 is outputted from the adder 14 as the excitation signal S6, which is then introduced into the closed loop through the adder 2.

In the closed loop, the excitation signal S6 is convoluted with the circulating signal S3 by the adder 2. As described before, the circulating signal S3 circulates through the filter 5, the delay circuit 4 and the gain control portion 3 while being attenuated by the gain control portion 3 using the gain G. The circulating signal picked up from the closed loop is supplied to the compensation circuit 31 shown in FIG. 4, in which the low-frequency components thereof are compensated before being outputted as the musical tone signal. Thereafter, the musical tone signal is supplied to the other circuitry (not shown) by which the corresponding musical tone is produced.

Incidentally, the gain G2 can be varied by operating the aforementioned control member provided in the tone-color designating portion 21; or the gain-conversion route can be changed by operating the manual-operable members of the tone-color designating portion 21. As a result, the tone color of the musical tone to be produced can be delicately altered. In other words, the tone color can be delicately altered in a process where the musical tone is attenuated. By merely returning the manual-operable members to their original positions, the tone color which has been slightly altered as described above can be easily changed to the original tone color which is set to the apparatus in advance.

Figure 6:
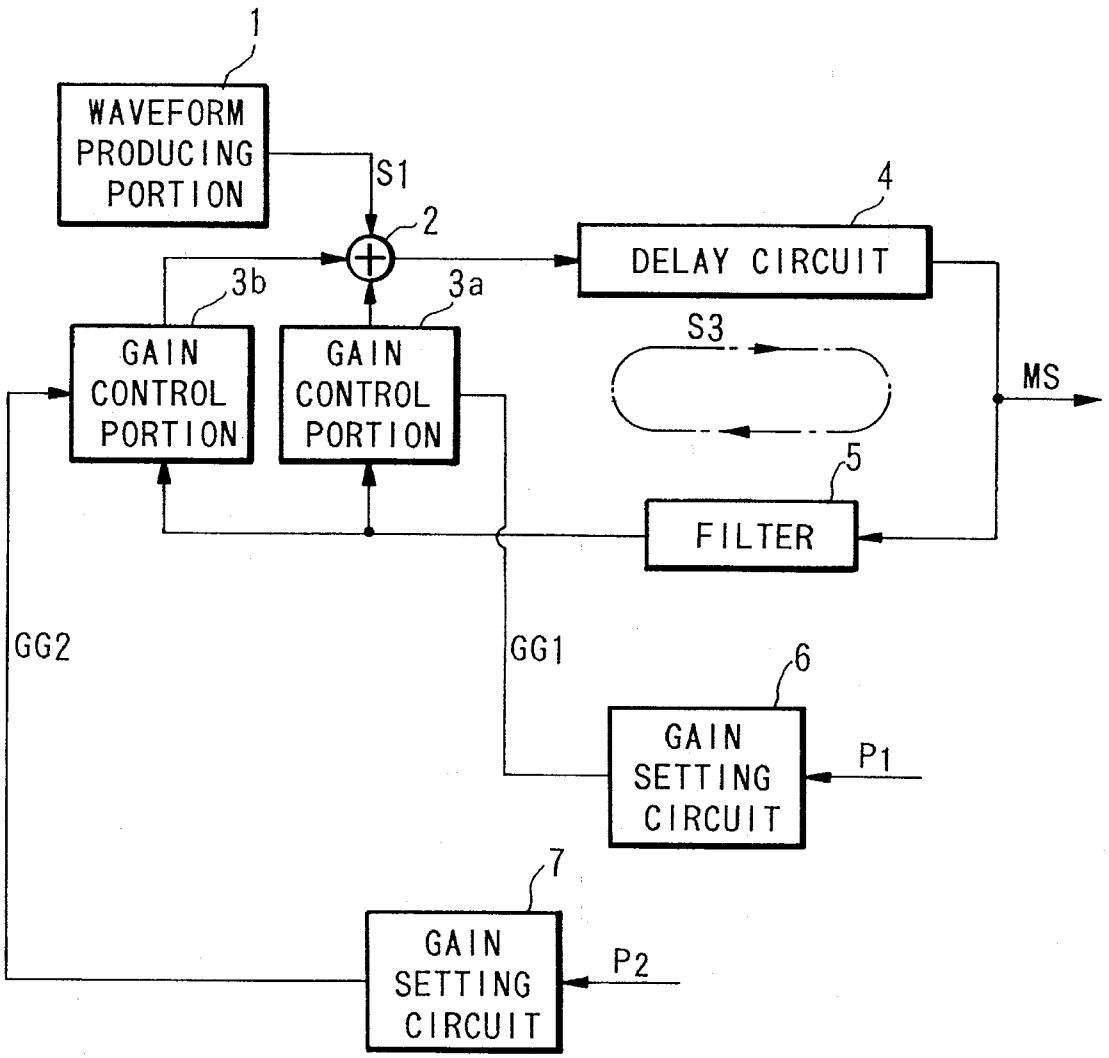
FIG. 6 is a block diagram showing a modified example of the musical tone synthesizing apparatus.

Next, a modified example of the present invention will be described by referring to FIG. 6. As compared to the foregoing embodiment shown in FIG. 1, the gain control portion 3 shown in FIG. 1 is replaced by a pair of gain control portions **3*a* and 3*b* in the example shown in FIG. 6. Those gain control portions 3*a* and 3*b* are connected in parallel and are configured by multipliers respectively. Herein, the gain control portion 3*a* performs a multiplication using the gain GG1 outputted from the gain setting circuit 6, while the gain control portion 3*b* performs a multiplication using the gain GG2 outputted from the gain setting circuit 7. In other words, the gain GG1 outputted from the selector 24 is supplied to the gain control portion 3*a*, while the gain GG2 outputted from the selector 26 is supplied to the gain control portion 3*b*. Thus, the gain control portion 3*a* multiplies the circulating signal S3 by the gain GG1, while the gain control portion 3*b* multiplies the circulating signal S3 by the gain GG2. Then, outputs of those gain control portions 3*a* and 3*b* are added with the fundamental waveform signal S1 by the adder 2**, the output of which is used as the circulating signal S3.

Next, the operations of the musical tone synthesizing apparatus will be described. The present apparatus is designed to produce the decay sounds like the guitar sounds and is also designed to play the feedback performance employed by the guitar.

At first, the performer depresses the key of the keyboard so as to designate the production of the musical tone having the predetermined tone pitch. Responsive to the key depression, the control portion 22 outputs several kinds of control parameters on the basis of a set of preset parameters which correspond to the tone color currently designated by the tone-color designating portion 21. If a normal performance technique for producing the normal guitar sounds is designated under the current situation, it is possible to produce the guitar sounds each of which is attenuated and muted down within five seconds. Now, when the foot pedal is depressed down by the performer while the above-mentioned guitar sounds are currently producing, it is possible to obtain the musical tones similar to the sounds which are obtained by playing the feedback performance on the guitar. In this case, each amount of depression of the foot pedal is set responsive to each value of the gain G2 in advance, so that only the gain G2 can be gradually increased from "0" by gradually depressing down the foot pedal while maintaining the gain G1 as it is. When a sum of the gains GG1 and GG2 which are added together by the adder 8 shown in FIG. 1 exceeds "1", a state of oscillation of the closed loop is changed from an attenuating state to a growing state. At this state, the waveforms should be clipped, so that the aforementioned musical tones similar to the sounds to be produced by playing the feedback performance on the guitar can be eventually obtained. The value corresponding to the above-mentioned sum of the gains GG1 and GG2 is also emerged at the output of the adder 27 shown in FIG. 3. This value, or the output of the gain setting table 28 is used to determine the multiplication coefficients IG1 and IG2. Those multiplication coefficients are used to control the characteristic of attenuating the low-frequency components of the excitation signal by the high-pass filter 11. In the case where the result of the addition performed by the adder 2 exceeds the maximum value which is fixed in response to the predetermined number of bits of the digital data to be used in the circuitry shown in FIG. 1, a logical operation unit is further provided so as to continuously output the maximum value as long as the output of the adder 2 exceeds the maximum value. Thus, the clipped waveforms can be easily obtained.

In the embodiment as described heretofore, the output of the high-pass filter 11 is controlled in response to the gain G. Instead, it is possible to modify the embodiment such that the output of the high-pass filter 11 is controlled in response to the signal level of the musical tone signal or the touch signal TOUCH, for example. In such modification, the filtering effect of the high-pass filter 11 is controlled to be larger as the signal level becomes larger, while the filtering effect is controlled to be smaller as the signal level becomes smaller.

Incidentally, each of the range of the values of the gain G and the ranges of the multiplication coefficients IG1 and IG2 can be controlled to be changed in response to the pass-band gain or frequency characteristic of each filter.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus comprising:

first parameter setting means for setting a first gain parameter in response to a tone color of a musical tone to be produced;

second parameter setting means for setting a second gain parameter in response to a music-performing operation;

loop circuit means for circulating a signal, said loop circuit means having a loop gain which is controlled on the basis of said first gain parameter and said second gain parameter, said loop circuit means including delay means for delaying said signal circulating in said loop circuit, said delay means having a delay time corresponding to a tone pitch of the musical tone to be produced;

excitation means for producing an excitation signal and introducing the excitation signal into said loop circuit means so that an oscillation is excited in said loop circuit means;

attenuating means for attenuating low-frequency components of the excitation signal; and attenuation control means for controlling said attenuating means so as to attenuate the low-frequency components in response to a value of the loop gain.

2. A musical tone synthesizing apparatus according to claim 1, wherein said attenuating means comprises a high-pass filter.

3. A musical tone synthesizing apparatus according to claim 1, further comprising:

means for extracting the musical tone signal from the loop circuit means;

compensating means, responsive to said extracted musical tone signal, for compensating said extracted musical tone signal in accordance with a predetermined compensation characteristic to produce a compensating musical tone signal.

4. A musical tone synthesizing apparatus according to claim 3, wherein said predetermined compensation characteristic corresponds to low-frequency compensation of said extracted musical tone signal.

5. A musical tone synthesizing apparatus according to claim 3, wherein said predetermined compensation characteristic corresponds to a characteristic of said attenuating means.

6. A musical tone synthesizing apparatus according to claim 3, wherein said predetermined compensation characteristic corresponds to a frequency characteristic of said attenuating means.

7. A device as defined in claim 1 wherein said attenuation control means controls said attenuating means such that an amount of low frequency attenuation is proportional to said loop gain.

8. A musical tone synthesizing apparatus comprising:

presetting means for presetting a plurality of preset parameters which are required for producing a musical tone;

loop circuit means for circulating an input signal, said loop circuit means including delay means for delaying the input signal by a delay time corresponding to a tone pitch of the musical tone to be synthesized;

first gain control means for controlling a loop gain of said loop circuit means in accordance with a first preset parameter included in said plurality of preset parameters;

performance-control-parameter setting means for setting a performance control parameter by which a variation is imparted to a tone quality of the musical tone to be produced;

second gain control means for controlling the loop gain of said loop circuit means in accordance with the performance control parameter;

excitation means for producing an excitation signal on the basis of a second preset parameter included in said plurality of preset parameters, wherein said excitation signal is introduced into said loop circuit means so as to excite an oscillation in said loop circuit means, so that said loop circuit means synthesizes a musical tone signal;

attenuating means for attenuating low-frequency components of the excitation signal; and attenuation control means for controlling said attenuating means so as to alter a characteristic for attenuating the low-frequency components in response to a value of the loop gain which is set by at least one of said first and second gain control means.

9. A musical tone synthesizing apparatus including excitation means for introducing an excitation signal into a loop circuit containing delay means for delaying the excitation signal, the delay means having a delay time which is set responsive to a tone pitch of a musical tone to be produced so as to synthesize the musical tone, said musical tone synthesizing apparatus comprising:

loop-gain setting means for setting a loop gain of said loop circuit, said loop-gain setting means being capable of changing the loop gain to be set to said loop circuit;

attenuating means for attenuating low-frequency components of the excitation signal; and attenuation control means for controlling said attenuating means so as to alter a characteristic for attenuating the low-frequency components in response to a value of the loop gain which is set by said loop-gain setting means which is set by said loop-gain means.

10. A musical tone synthesizing apparatus comprising:

excitation means for producing an excitation signal in response to a musical tone to be produced, which is designated by a performer;

high-pass filter means for performing a high-pass filtering operation on the excitation signal so as to remove dc components therefrom;

mixing means for mixing an output of said high-pass filter means and the excitation signal in accordance with a mixing rate;

loop circuit means to which an output of said mixing means is introduced, said loop circuit means at least providing delay means and gain control means, said delay means having a delay time which is set responsive to a tone pitch of the musical tone to be produced, said gain control means controlling a loop gain of said loop circuit means;

pick-up means for picking up a signal circulating through said loop circuit means as a musical tone signal; and compensation means for compensating for low-frequency components of the musical tone signal.

11. A musical tone synthesizing apparatus as defined in claim 10 further comprising control means which produces a gain parameter and a mixing parameter, wherein said gain parameter is produced responsive to a tone color of the musical tone to be produced and is used for controlling said gain control means so as to eventually control the loop gain of the loop circuit means, while said mixing parameter is produced responsive to said gain parameter and is used for controlling the mixing rate.

12. A musical tone synthesizing apparatus as defined in claim 10 wherein said gain control means is a multiplier whose multiplication coefficient is controlled responsive to a tone color of the musical tone to be produced.

13. A musical tone synthesizing apparatus as defined in claim 10 wherein said compensation means contains a compensation filter whose filtering characteristic is set reverse to that of said high-pass filter means.

* * * * *